United States Patent [19]

Dupuis

[11] Patent Number: 4,501,434

[45] Date of Patent: Feb. 26, 1985

[54] VEHICLE FOR A FUN-FAIR OR THE LIKE

[75] Inventor: Jean L. Dupuis, Braine-L'Alleud, Belgium

[73] Assignee: D. M. International Ltd., London, England

[21] Appl. No.: 419,140

[22] Filed: Sep. 17, 1982

[51] Int. Cl.[3] ..... A63G 23/00; A63G 29/00

[52] U.S. Cl. ..... 280/206; 180/10; 188/330; 272/1 R; 272/11 S; 441/78

[58] Field of Search ..... 280/206; 180/10; 188/74, 78, 330; 272/1 R, 1 B, 11 S; 441/66, 78, 72, 79, 129, 130, 136

[56] References Cited

U.S. PATENT DOCUMENTS

| | | | |
|---|---|---|---|
| 2,687,546 | 8/1954 | Oppenheimer | 188/74 |
| 2,838,022 | 6/1958 | Wilson | 280/206 |
| 3,000,022 | 9/1961 | Cathey et al. | 280/206 |
| 3,013,806 | 12/1961 | Boyd | 280/206 |
| 3,746,117 | 7/1973 | Alred | 280/206 |
| 4,386,787 | 6/1983 | Maplethorpe et al. | 180/10 |

FOREIGN PATENT DOCUMENTS

| | | | |
|---|---|---|---|
| 1292441 | 10/1972 | United Kingdom | 280/206 |

*Primary Examiner*—Joseph F. Peters, Jr.
*Assistant Examiner*—Mitchell J. Hill
*Attorney, Agent, or Firm*—Walter H. Schneider

[57] ABSTRACT

The vehicle comprises an element which forms a wheel, preferably a sphere 11 having an outer bearing surface and an inner bearing surface and, inside the wheel 11, an element which forms a preferably hemispherical car 1 for at least one passenger, said car 1 being adapted to slide along the inner surface of the wheel 11 when the latter rotates.

3 Claims, 10 Drawing Figures

1
5
4

2
10
6
3
37
21
X
8
24
9
11
4
28
29
31
30
10
32

1
33
11
2

109
110
11
27
102
1
2
14
14
106
2
2
7
108
103
105
111
107
100
101

VEHICLE FOR A FUN-FAIR OR THE LIKE

This invention relates to a vehicle for a fun-fair or the like, and may be produced on a small scale as a game or toy.

The invention relates to a vehicle for one or more passengers adapted to follow a predetermined path over water, land or overhead, while allowing the passenger or passengers some initiative in respect of the movement of the vehicle so as to enhance the enjoyment of the ride.

To this end, the vehicle comprises an element forming a wheel having an outer and an inner bearing surface, and inside the wheel an element which forms a car for at least one passenger, such car being adapted to slide along the inner bearing surface of the wheel when the latter rotates.

More particularly, the wheel comprises a sphere, the outer surface of which forms the outer bearing surface and the inner surface of which forms the inner bearing surface of the wheel. In that case, preferably, the car is itself hemispherical and comprises means to allow it to roll inside the spherical wheel and means for braking the rolling of the car inside the sphere. Preferably, the bearing means for the car inside the sphere are secured to the car at the equator of the sphere.

The above and other features of the invention will be described hereinafter with reference to the accompanying drawings wherein.

In the various drawings, like references denote like parts.

Figure 1:
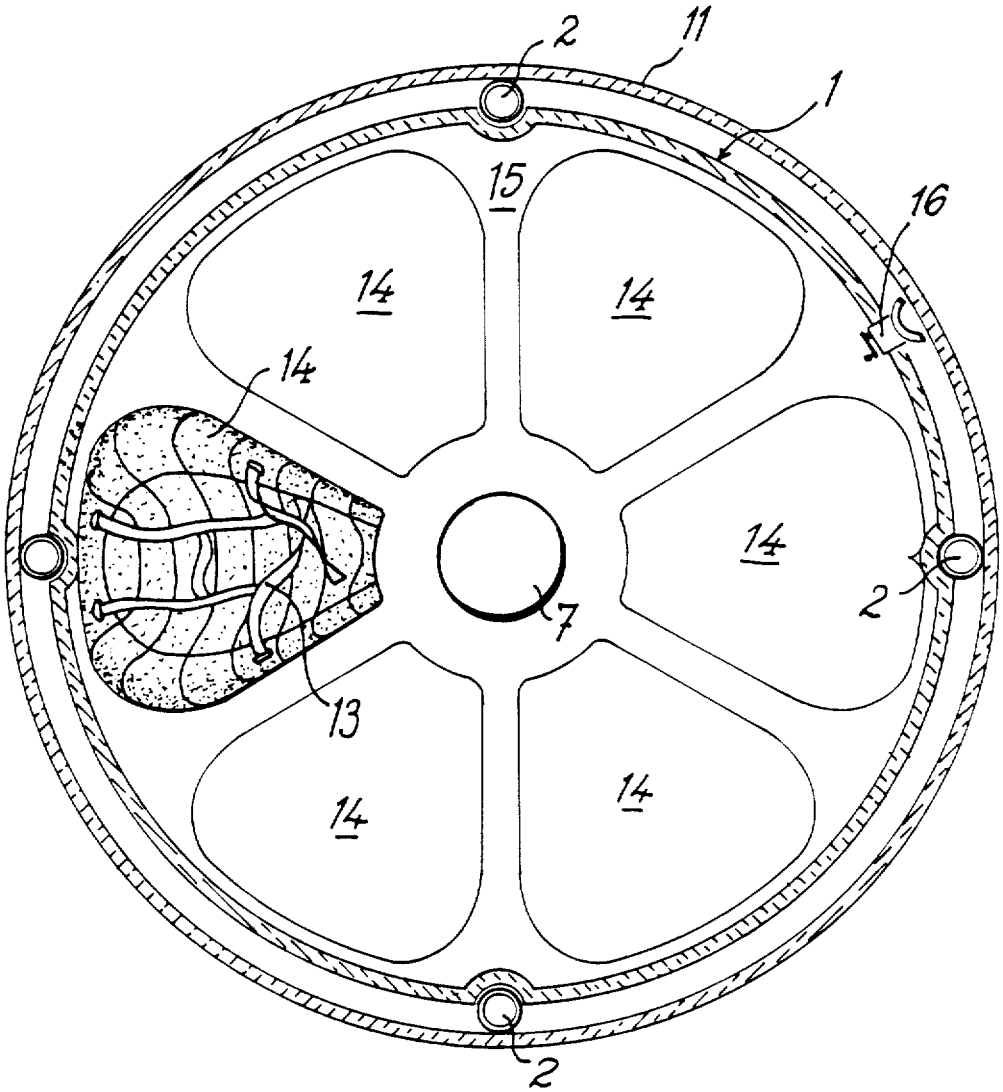
FIG. 1 is a top plan view showing the unit comprising the outer sphere and the inner hemisphere or car.

As illustrated, the fun-fair vehicle capable of rolling on itself and floating on water comprises an inner hemisphere or car 1 inside an outer sphere 11. The car is mounted to roll inside the sphere 11 by means of rollers 2 which have a tread of Teflon or some similar non-scratch material. In this embodiment, the car contains six seats 14 provided with safety belts 13. Access corridors 15 are provided between the seats 14.

When the outer sphere 11 rotates on itself, the car 1 rolls inside the same and retains a horizontal attitude because of the weight of the passengers. The weight of the car can be increased if necessary, e.g. by means of a cast-iron frame. A foot control 7 provided with a compensating spring 17 enables a brake to be actuated on the rollers 2. In this way the car 1 can follow the rotation of the outer sphere 11 and, if necessary, perform a complete revolution on itself with the passengers therein. As it rotates in a vertical or other plane, car 1 can therefore loop the loop or perform some other rotation in any plane. This movement stops as soon as the control 7 is released, the car 1 then starting to roll inside the sphere 11 again. A sucker 16 enables the car 1 to be secured inside the sphere 11 more particularly during boarding or alighting of the passengers.

Figure 2A:
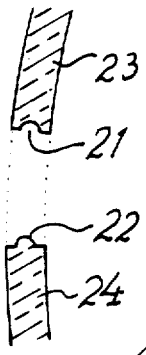
FIG. 2A is a detailed sectional view of the contact edges of the upper and lower segments of the outer sphere.
Figure 2:
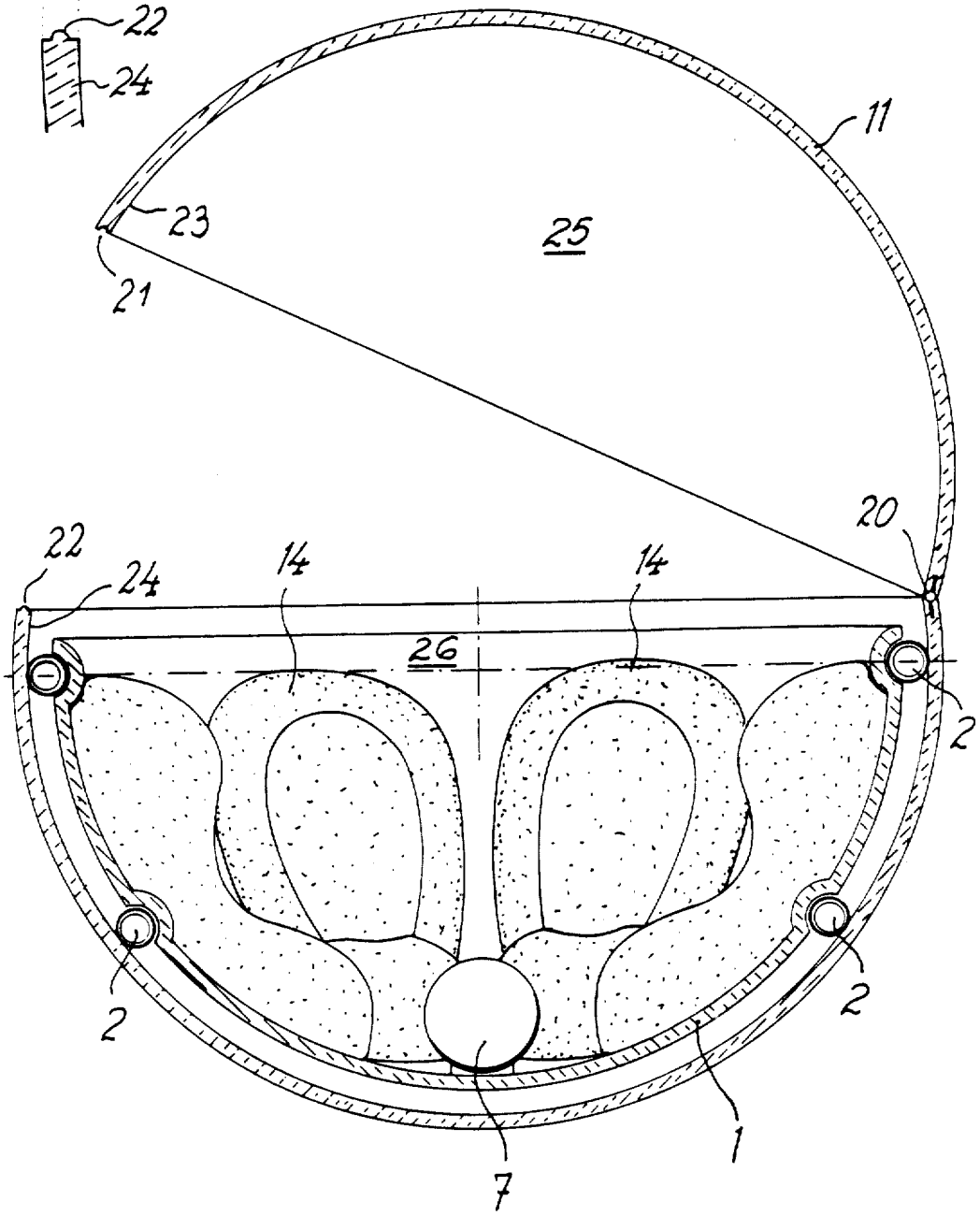
FIG. 2 is a sectional view of the unit comprising the outer sphere and the inner hemisphere to show the outer sphere half-open.

The sphere 11 consists of two segments and opens as shown in FIG. 2, for which purpose it has a spring hinge 20. Sealing-tightness is provided by the matching shape of a groove 21 and a rim 22 on the edges 23 and 24 respectively of the segments 25 and 26 respectively of the sphere 11.

Figure 6:
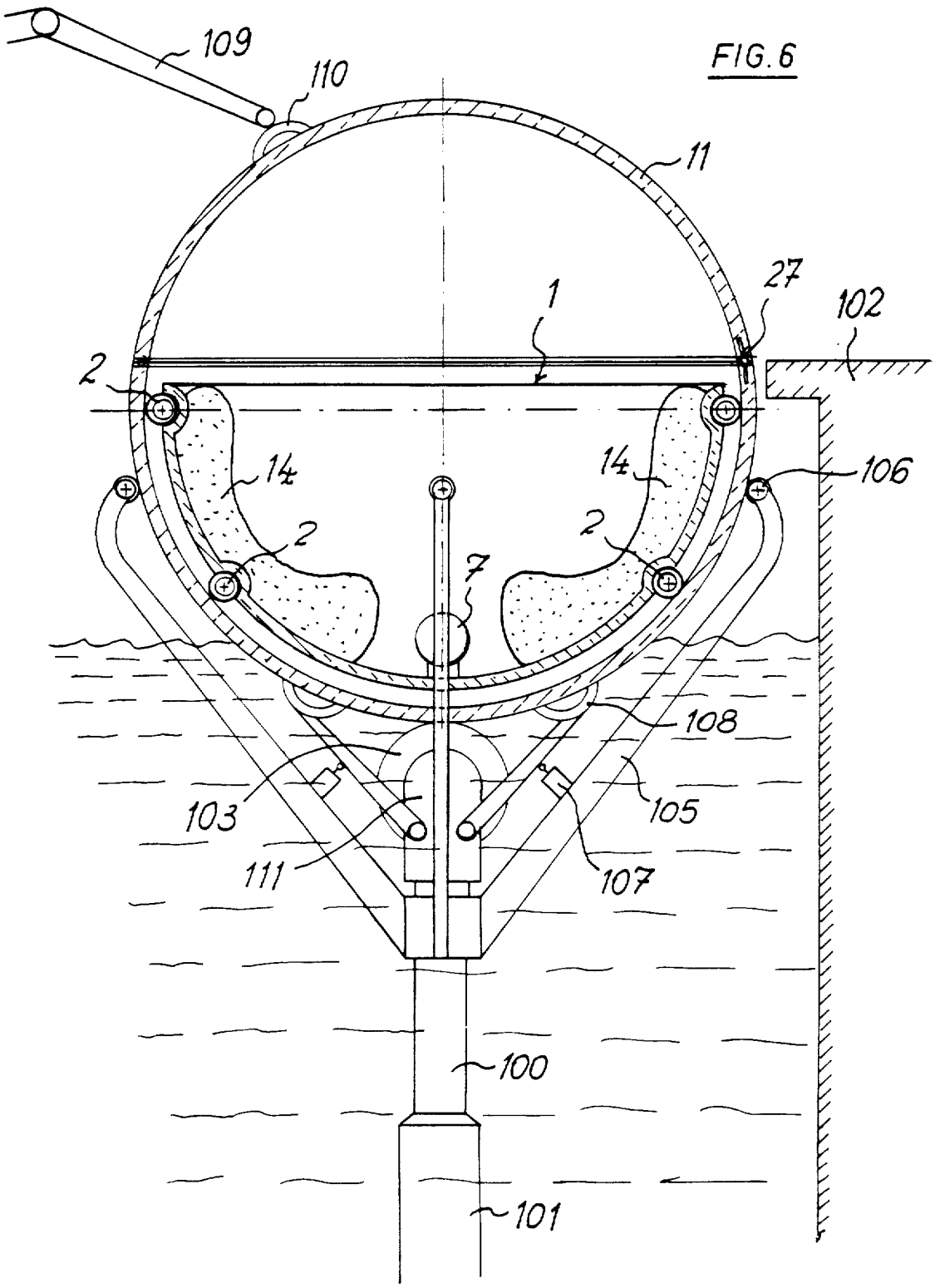
FIG. 6 is a perspective view of a sphere placed on a boarding jack.

The smaller segment 25 forms a cover which can be pivoted down on to the segment 26, which forms a receptacle for the car 1. A bolt 27 which can be actuated from either outside or inside holds the sphere 11 closed. FIG. 2A is a detail showing the contact edges 23 and 24 while the bolt is shown in FIG. 6. The sphere is preferably made of Plexiglass or any other completely or partially transparent material.

Figure 3:
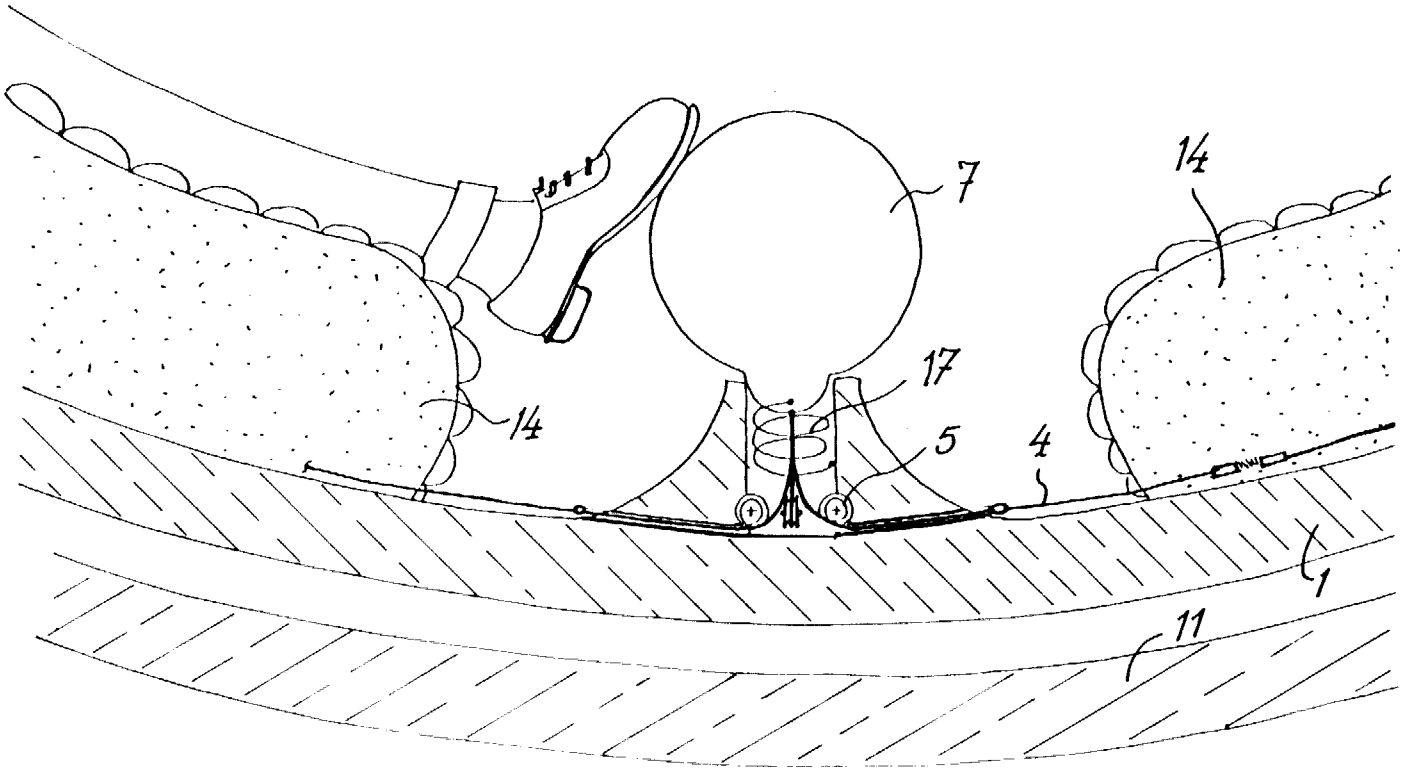
FIG. 3 is a sectional view to a larger scale of a detail showing the control of the braking of the half-sphere in relation to the sphere.

FIG. 3 is a detail showing the central braking control comprising a bulb 7, brake cables 4, and guide pulleys 5. Pressure on the bulb exerts a pull on the brake cable 4 which acts to brake the bearing rollers 2, as will be seen in greater detail in FIG. 4.

A link 10 connects cable 4 to a pull rod 6 articulated at one end of a pivoting lever 21, at the other end of which there is articulated a lever 8 connected to one end of a brake pad 9, the other end of which is mounted on a pivot 24. Tension on cable 4 actuates lever 6 in the direction of arrow X and causes the shoe 9 to move down against the inner surface of the roller 3. A return spring 37 assists in holding the shoe 9 in the non-braking position as soon as the tension on the cable 4 stops.

Figures 4, 4A, 4B:
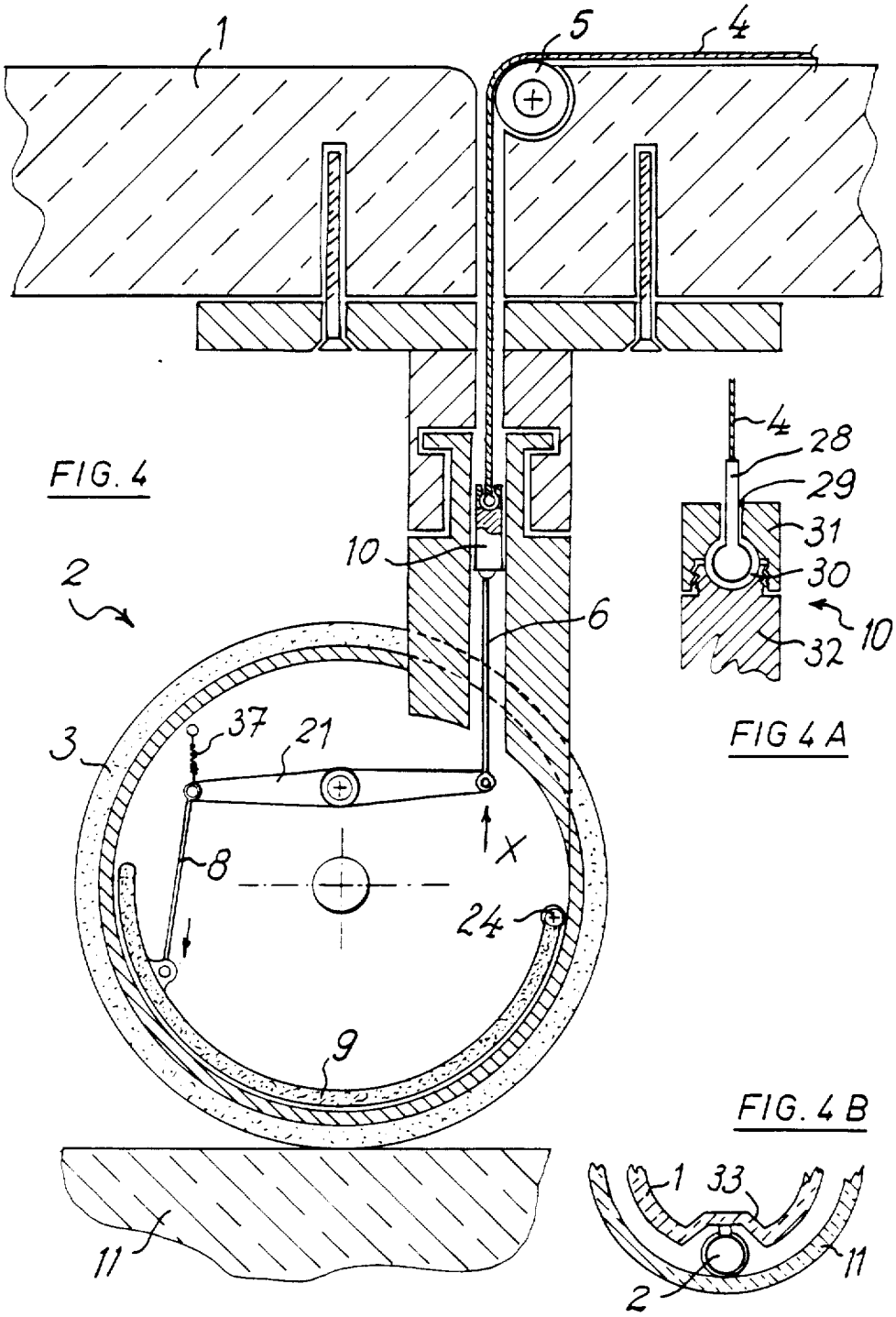
FIGS. 4 and 4A are also larger-scale sections of details of the braking system for one of the bearing rollers.
FIG. 4B is a variant of the bearing roller arrangement.

FIG. 4A is a detail of the link 10 connecting the cable 4 to the pull rod 6. The end 28 of cable 4 is received in a cavity 30 in the link 10 via a bore 29 and can rotate freely therein about its axis. In this way the roller 2 can rotate on itself without twisting the cable 4. The two parts 31 and 32 of the link 10 screw into one another.

FIG. 4B is a variant in which the rollers 2 are received in cavities 33 in the car 1 in order to increase the dimensions thereof while saving space. These cavities which are disposed at the access corridors, form access steps therein.

Figure 5:
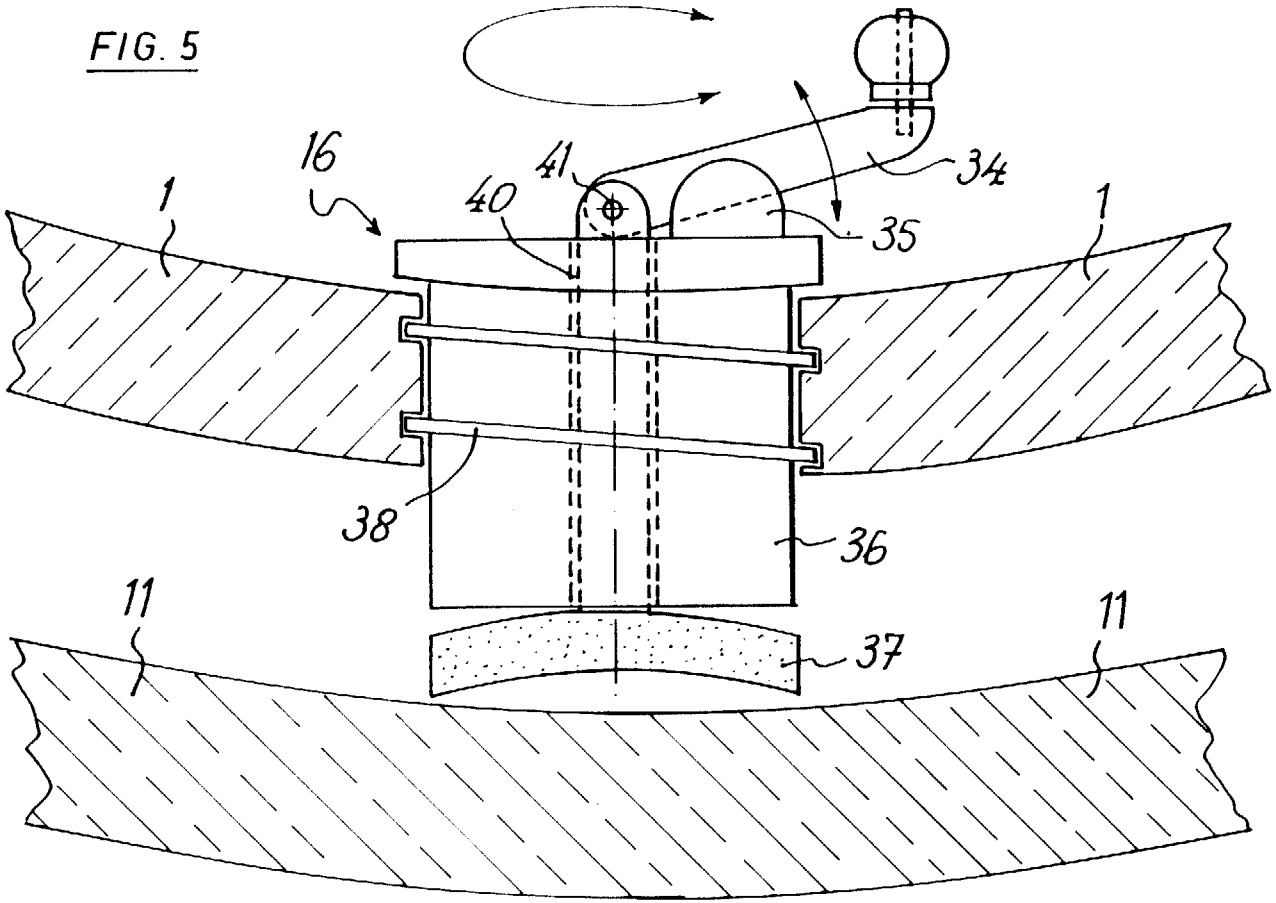
FIG. 5 is a larger-scale sectional view of a suction device for locking the inner hemisphere in relation to the outer sphere during the boarding or alighting of passengers.

In order to enable passengers to board and alight without the car 1 rocking, a window sucker 16 secures the car 1 to the sphere 11 (FIG. 5).

A lever 34 secured in a fork 35 and thus connected to the body 36 enables the actual sucker 37 to move towards or away from the sphere 11 through the agency of the screwthread 38 as the lever 34 rotates in the clockwise direction. Sucker 37 is connected to lever 34 by a rod 39 passing through a bore 40 and articulated at 41. When the sucker is applied to the wall 11, a downward pressure on the lever 34 enables the sucker to be released.

Referring to FIG. 6, a boarding jack 100 mounted on a hydraulic piston 101 enables the sphere 11 to be raised to the lever of a boarding stage 102. Jack 100 has a remote-controlled support wheel 103 actuated by a motor 104 (FIG. 7) more particularly for horizontal positioning of the opening of the sphere 11. The operator opens the bolt 27, lifts the cover 25 and actuates the sucker 16 to secure the car 1 to the outer sphere 11. The sphere thus stabilised at the landing stage enables passengers to board or alight. It is borne by arms 105 provided with rollers 106, and arms 107 provided with suckers 108, which are brought into contact with the sphere 11 as soon as it reaches the horizontal position. An additional arm 109 with a sucker 110 connected to the landing stage 102 enables the sphere to be opened. The various arms 105, 107 and 109, the wheel 103 and the jack 100 are controlled from the landing stage.

Figure 7:
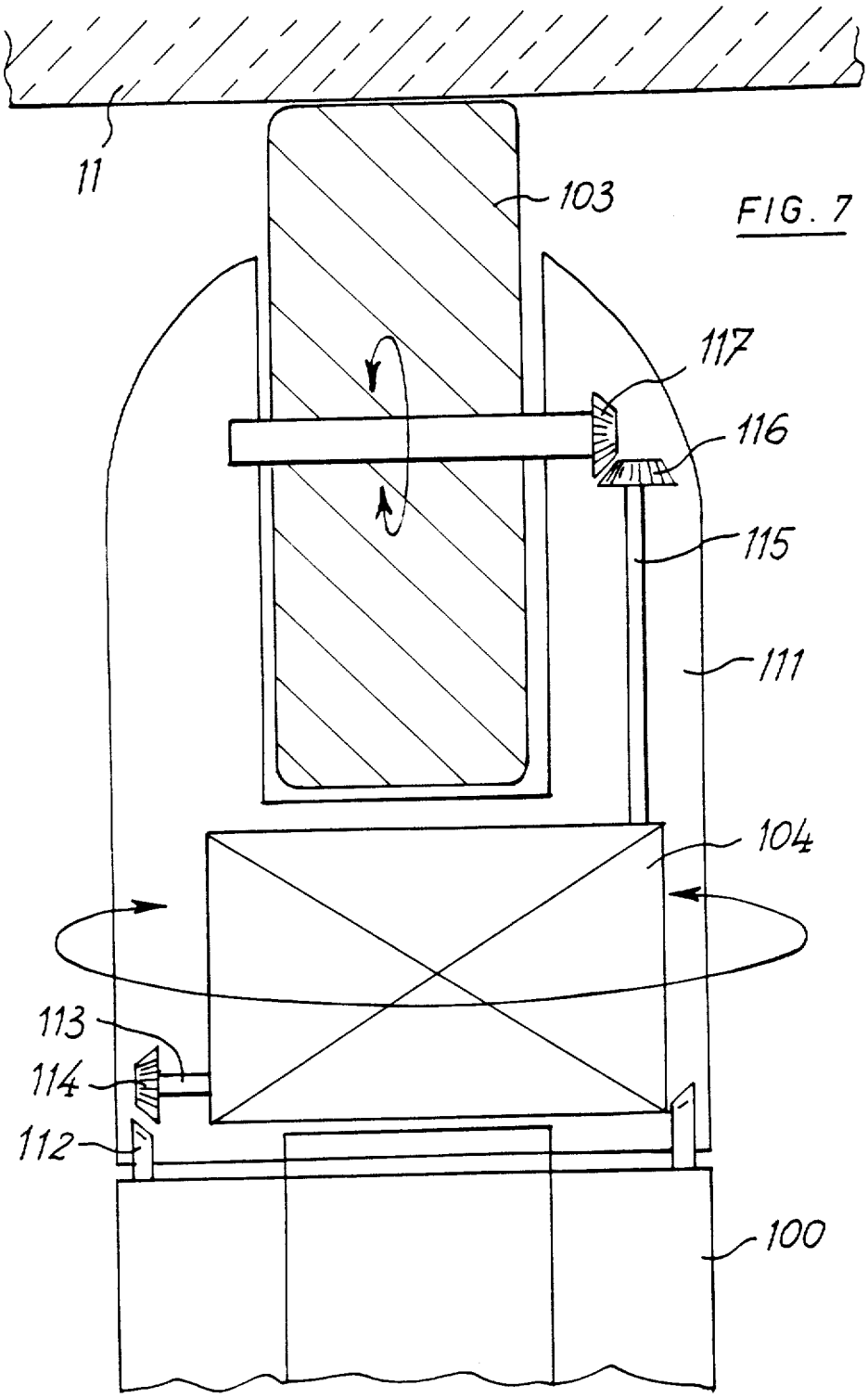
FIG. 7 is a detail of the system for rotating the sphere in relation to the boarding jack.

FIG. 7 is a detail of the mechanism for driving and rotating the wheel 103. This mechanism forms part of a head 111 which is rotatable with respect to the rest of the jack 100. Head 111 of jack 100 is mounted rotatably with respect to the horizontal axis of the jack for which purpose the non-rotary end of the jack has a circular rack 112 and motor 104 has a horizontal shaft 113 provided with a pinion 114 meshing with the rack 112 to turn the head 111 about its longitudinal axis. Motor 104 has a second vertical shaft 115 provided with a pinion 116 co-operating with another pinion 117 to drive the wheel 103. The two shafts 113 and 115 can be controlled independently of one another.

When the vehicle is level with the landing stage, an operator opens the cover by remote control. The passengers enter and the cover is closed. The sucker is released to free the car inside the sphere. The jack lowers and the vehicle floats. It can be driven by a current to a given point where an appropriate device removes it from the water and places it on land or an overhead track of an inclination sufficient to cause the sphere to roll. Two rails (covered with a sheathing of Teflon or any other non-scratch material) will guide the sphere over its entire path and provide safety. Each time the sphere rotates the car rolls inside the sphere and thus retains its attitude. When a passenger actuates the brake, the car ceases to roll with respect to the outer sphere and follows the movement of the latter as long as the brake acts. The car can thus be made to turn on itself in every direction.

To enable passengers to alight from a water-course the vehicle is brought to within the range of a lifting jack and is raised to the landing stage level, is positioned by rotation of the support wheel at the end of the jack, and then the reverse operations to those described above for boarding are carried out.

Of course the invention is not limited to the above described details, which are given solely by way of example.

What is claimed is:

1. A vehicle comprising a sphere adapted to freely rotate upon its outer surface having separate upper and lower segments pivotally connected at a point on the periphery of the sphere thereby permitting opening and closing of the sphere; a car comprising a spherical segment provided with at least one means on its outer surface adapted to rotatingly bear against the inner surface of said sphere thereby separating said car from said inner surface while permitting free rotational movement of said car apart from the rotational movement of said sphere; at least one seat within said car adapted to receive and secure a passenger therein; and means associated with at least one of said bearing means for braking the rotational movement of said car with respect to said sphere thereby permitting said passenger to control the rotation of said car with respect to the rotation of said sphere, said braking means comprising a braking surface adapted to contact the inner surface of said bearing means thereby securing said bearing means against rotation.

2. A vehicle according to claim 1 in which the braking surface is actuated by said passenger through a mechanical lever means connected thereto through a linkage means.

3. A vehicle according to claim 2 in which said car is provided with a plurality of seats conforming essentially to the contour of its spherical segment.

* * * * *